United States Patent [19]

Lewis et al.

[11] Patent Number: 4,942,986

[45] Date of Patent: Jul. 24, 1990

[54] PRESSURIZED TUNDISH FOR CONTROLLING A CONTINUOUS FLOW OF MOLTEN METAL

[76] Inventors: Thomas W. Lewis, 964 Cork Dr., Bethel Park, Pa. 15102; Paul E. Hamill, Jr., R.D. #1, Box 173A1, Jeannette, Pa. 15644; Mustafa R. Ozgu, 790 Yorkshire Rd., Bethlehem, Pa. 18017; Ralph C. Padfield, 1918 Paul Ave., Bethlehem, Pa. 18018; Donovan N. Rego, 1703 W. Brown St., Allentown, Pa. 18104; Guido P. Brita, 3225 Edna Terrace Ave., Bethlehem, Pa. 18017

[21] Appl. No.: 218,823

[22] Filed: Jul. 13, 1988

[51] Int. Cl.[5] ..... C21B 3/00

[52] U.S. Cl. ..... 222/590; 266/275; 164/335

[58] Field of Search ..... 266/45, 49, 239, 236, 266/275; 222/590, 591; 164/335, 337

[56] References Cited

U.S. PATENT DOCUMENTS

| | | | |
|---|---|---|---|
| 2,846,740 | 8/1958 | Edstrand | 266/239 |
| 3,404,725 | 10/1968 | Kapun | 266/239 |
| 3,675,911 | 7/1972 | Kapun | 266/239 |
| 3,844,453 | 10/1974 | Eickelberg | 266/239 |
| 4,010,876 | 3/1977 | Steinemann | 164/337 |
| 4,770,395 | 9/1988 | Vo Thanh et al. | 266/275 |

*Primary Examiner*—S. Kastler

*Attorney, Agent, or Firm*—Sigalos, Levine & Montgomery

[57] ABSTRACT

A pressurized tundish for controlling a continous flow of molten metal characterized by having a pair of principal compartments, one being essentially unpressurized and receiving molten metal introduced thereto, and the other being adapted for maintaining a controlled gaseous pressure over the surface of the fluid metal therein, whereby, by controlling the pressure within the pressurized chamber, metal exiting from the tundish is made to flow continually and at a controlled rate.

12 Claims, 1 Drawing Sheet

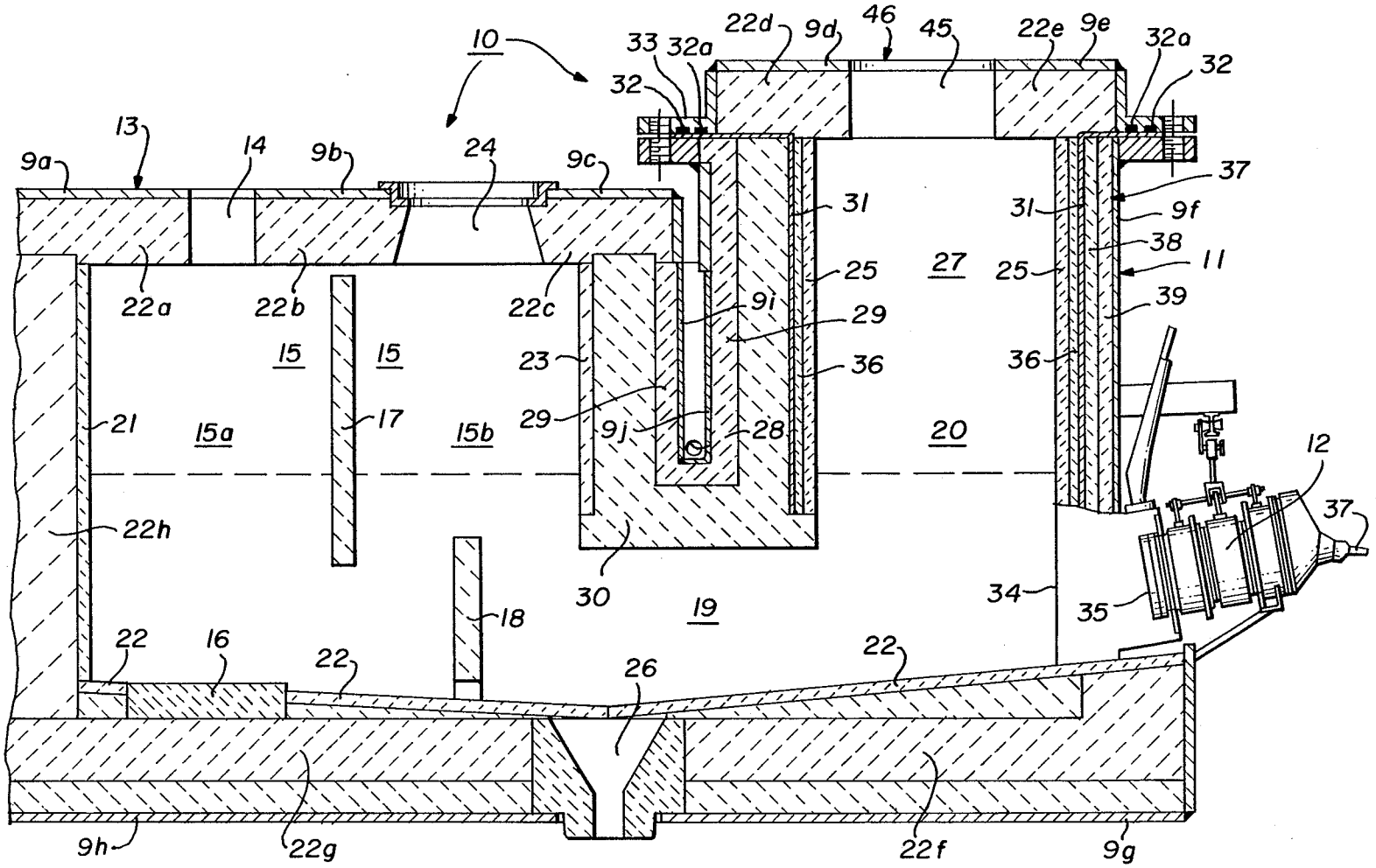
10
11
12
13
14
15
15a
15b
16
17
18
19
20
21
22
22a
22b
22c
22d
22e
22f
22g
22h
23
24
25
26
27
28
29
30
31
32
32a
33
34
35
36
37
38
39
45
46
9a
9b
9c
9d
9e
9f
9g
9h
9i
9j

PRESSURIZED TUNDISH FOR CONTROLLING A CONTINUOUS FLOW OF MOLTEN METAL

The Government of the United States of America has rights in this invention pursuant to Contract No. DE-FC07-84IDI2545 awarded by the U.S. Department of Energy.

BACKGROUND OF THE INVENTION

This invention relates to the flow control of molten metal and more particularly to continuous flow of molten steel.

A variety of flow controls for molten metals have heretofore been proposed, illustrative of which are those described in U.S. Pat. No. 3,675,911, granted to Walter Kapun on July 11, 1972; U.S. Pat. No. 3,844,453, granted to Henry Eickelberg on Oct. 29, 1974; and U.S. Pat. No. 4,010,876 granted to Robert Steinemann on Mar. 8, 1977. These patents, while teaching the use of multi-compartmented apparatus for controlling metal flow by use of pressurization within one of the compartments, have nevertheless been limited to providing successive batches or sequences of molten metals rather than providing for continuous controlled measured flow. Other proposals have been made for controlling metallic flow from tundishes, illustrative of which is that described in U.S. Pat. No. 4,770,395 granted to Khuong Vo Thanh et al on Sept. 13, 1988. According to one such proposal, "flow from the tundishes into the mold was controlled by a stopper rod suspended above the nozzle entry and linked to a manual lever." Accordingly, there has continued to be a need for apparatus that is long lived, economical and more readily controllable to provide for continuous flow control and flow of molten metal for such applications as continuous casting.

SUMMARY OF THE INVENTION

In accordance with the present invention, a two-compartment tundish is provided having within the first compartment a splash plate and holding area for receiving molten metal at a non-uniform input rate, e.g., by discrete batches of molten steel introduced thereto from suitable conveying means such as a ladle. The steel is introduced at a location offset from the center thereof and disposed toward the rear of the tundish so as to permit the interposition of suitable baffles to smooth out the turbulence and other adverse effects resulting from pouring of the molten metal into the first compartment. A longitudinal passageway within the tundish located near the lower extremity of the interior provides a passage for communication between the receiving compartment and the pressure compartment. Within the pressure compartment there exists a vertically oriented space that permits a substantial rise or fall of the level of steel therewithin; and at or near the front extremity of the tundish and located a relatively small predetermined distance above the bottom of the pressure chamber interior, there is located a nozzle through which molten steel is controllably exited. Inert gas preferably is employed as the pressurizing agent within the pressure chamber, and by controlling the pressure of such gas on the surface of the molten metal, the rate at which the metal is discharged through the nozzle can be readily controlled. Pressure integrity is provided by a particularly efficacious sealing mechanism comprising a walled box-like member and cooperating O-ring type seals.

Thus, there is provided a multi-sectioned tundish which provides for entry of molten steel in discrete increments, yet provides for the smooth and continuous controlled discharge of the molten metal.

OBJECTS AND FEATURES OF THE INVENTION

One general object of the invention is to improve tundishes.

It is another object of the invention to provide a mechanism for receiving molten metal in discrete batches and for converting same into uniform continuous controlled flow.

It is still another object of the invention to provide pressure integrity within a pressurized chamber of the tundish.

It is yet another object of the invention to improve flow control in a horizontal continuous caster.

Accordingly, in accordance with one feature of the invention, a baffled receiving compartment is provided for the receipt of molten metal in discrete batches, provision being made to receive the metal toward the rear of the tundish thereby providing geometries conducive to positioning of intermediate baffles in the metal stream so as to smooth out the effects of pouring turbulence and impact.

In accordance with still another feature of the invention, a passageway connects the first compartment, i.e., the metal receiving compartment, from the second compartment which is adapted for maintaining a controlled gaseous pressure over the surface of any fluid material therein such as molten steel, thus enhancing elimination of turbulence or other non-steady state conditions within the molten stream while providing a necessary communication between the two chambers.

In accordance with yet another feature of the invention, the tundish exit nozzle is located a predetermined distance vertically above the lowest interior level within the tundish so as to further mitigate irregularities in metal flow while at the same time being positioned sufficiently low so as to permit a wide excursion of molten metal levels within the pressure chamber without exposing the nozzle entry aperture to pressurized gas.

In accordance with yet one further feature of the invention, a light gauge stainless steel box is positioned within the refractory walls of the pressure chamber, is protected by appropriate insulating refractories while providing, in combination with O-ring seals, an effective mechanism for sealing the pressure chamber and preventing undesired pressure leaks.

These and other objects and features of the invention will be apparent from the following detailed description, by way of example of a preferred embodiment, in which FIG. 1 depicts in section the tundish according to the invention.

DETAILED DESCRIPTION OF THE INVENTION

Now turning to the drawing, it will be observed that it depicts in vertical section a two-chambered tundish 10 especially adapted for the handling of molten metal such as steel. Projecting from the front 11 is metal exit nozzle 12, and near the top rear 13 of the tundish there is provided aperture 14 through which molten metal may be poured into the tundish from any suitable source (not shown). Essentially centered beneath aperture 14 and at the bottom of receiving chamber 15 is conventional splashplate 16, which may be made of any suitable refractory material well-known in the art.

Receiving chamber 15 is fitted with vertical baffles 17 and 18, which, again, may be formed of any suitable conventional refractory material well-known in the art. Baffle 17 provides a partial barrier to prevent or mitigate propogation of the fluid anomolies such as turbulence and waves resulting from the pouring of molten metal into the tundish. Baffle 18 acts in a similar fashion, and the geometrical positioning of baffle 17 and 18 provides for a passageway from the left side of compartment 15, that is, subcompartment 15*a* to subcompartment 15*b* and thence through the passageway 19 which provides ready fluid communication between receiving chamber 15 and pressure chamber 20. The interior walls that are to come in contact with molten metal are lined in the conventional way with any one of a variety of known refractory materials. This is illustrated for chamber 15 by rear refractory lining 21 (tundish boards or insulating spray material), bottom refractory lining 22 (similar to lining 21) and inner wall refractory lining 23 (also similar to lining 21). The tundish boards or insulating spray material overlie other conventional refractories, e.g., refractory brick 22*g*, 22*h*, 22*i*.

The tundish generally is enclosed within an exterior casing 9, preferably of steel, shown as sections 9*a*–9*j* on the figure. Within that exterior steel casing, there are included conventional insulating and refractory layers such as layers 22*a*–22*h*. These layers of insulation and refractory materials (e.g., refractory bricks) provide protection to the exterior steel casing from the extreme heat of the molten metal.

Now returning to input chamber 15, it will be observed that it further includes within a location essentially central to the top of subchamber 15*b*, a closable opening 24 which, when opened, provides access to the interior of subchamber 15*b*, thus permitting access for inspection.

In order to provide a means for completely emptying the tundish, there is provided in the bottom thereof a drain port 26 which is normally closed to prevent unwanted exit of molten metal, but which may be opened when it is desired to drain the remaining molten metal from the tundish. Such drain is conventional and is actuated in a conventional manner as is known to those skilled in the art As mentioned above, pressure chamber 20 communicates with reception chamber 15 by way of passage 19, which permits the flow of metal therebetween. However, as will be observed from reference to the drawing, there are vertically disposed members that provide separation for the upper portion 27 of chamber 20 from the upper portion of subchamber 15*b*. These include two spaced apart portions of exterior casing 9*i* and 9*j* into the bottom space of which there is piped a source of cooling air 28. Lining these extensions 9*i* and 9*j* are sections of insulating material 29 together with other insulating and protective materials 30.

Because of the necessity of maintaining pressure integrity within the upper portion 27 of pressure section 20, provision is made for gas tight construction by the advantageous inclusion of a light gauge stainless steel box 31 which lines the refractory walls of the pressure chamber and is protected from the extreme heat of the molten metal by 1½-inch thick magnesite tundish boards 25. Also provided is 1-inch thick layer 36 of similar tundish boards.

Box 31 is made of four steel walls, the opposing walls being parallel. Steel box 31 is additionally supplemented in its maintenance of gas-tight integrity by the efficacious employment of a pair of O-rings 32 and 32*a* which seal the flange 33 of the burner cover (9*d* and 9*e*). The innermost O-ring 32*a* contacts the flange of the stainless steel box.

Between steel casing section 9*f* and wall 37 of steel box 31 there are positioned a refractory castable 38 and layer 39 of insulating brick.

Horizontal feeding system 12 is in fluid communication with compartment 20 through port 34. Molten metal therefore can be controllably flowed from the lower portion of pressure chamber 20 through port 34 and thence into the fluid-conducting passageway 35 to an internal passageway (not shown) and thence to the nozzle exit opening 37.

Although the base region of horizontal feeding system 12 is affixed to the tundish exterior, provision may be made within an intermediate part of horizontal feeding system 12 for the end section to be swiveled, thereby to provide for adjustment.

For a description of horizontal feeding system 12, reference is made to U.S. Patent Application Ser. No. 218,689 filed on even date herewith.

Returning now to the pressure chamber, it will be observed that at the top thereof there is an opening 45 which is a burner outlet. The burner (not shown) is employed to preheat the tundish and horizontal feeding system.

It is contemplated that an inert gas such as argon be employed as the gaseous medium overlying the molten metal within the pressure chamber 20. However, other types of inert gases may also be employed. Pressure to the pressure chamber is controlled by conventional pressure controlling mechanism (not shown), and the entry of the gas into the pressure chamber is preferably made to the pressure chamber at the upper region thereof e.g., through burner port 45. This also is accomplished by conventional means.

While the invention has been described in connection with a preferred embodiment, it is not intended to limit the scope of the invention to the particular form set forth, but, on the contrary, it is intended to cover such alternatives, modifications and equivalents as may be included within the spirit and scope of the invention as defined by the appended claims.

What is claimed is:

1. A tundish having a first main unpressurized chamber means for receiving molten metal in discrete increments and a second pressurized chamber means in fluid flow communication with said first chamber means for receiving molten metal from said first chamber means on a continuous basis, said second chamber means comprising a metallic box having a flanged cover, a pair of "O" rings at the flange of said flanged cover, and means for controllably introducing a pressurized inert gas into said metallic box.

2. A tundish according to claim 1 in which there is located at a predetermined position within said first main chamber means a first baffle, the bottom of said first baffle being located a predetermined height above the bottom of said first chamber to permit flow of molten metal beneath said baffle, said baffle being of sufficient height to project upwardly above the surface of molten metal within said first chamber.

3. A tundish according to claim 2 in which there is located at a predetermined position within said first chamber, means a second baffle extending upwardly from the bottom of said chamber means and ending beneath said surface of said molten metal, said second baffle being positioned downstream of said first baffle.

4. A tundish according to claim 1 wherein at the exterior of said second chamber means there is positioned a spout in fluid communication with the interior of said second chamber means, the connection of said spout to said chamber being located a predetermined height above the interior bottom of said second main chamber means.

5. A tundish according to claim 1 wherein said metallic box is positioned within the walls of said second chamber means.

6. A tundish according to claim 5 wherein said metallic box is made of stainless steel.

7. A tundish according to claim 1 wherein said first main chamber means and said second main chamber means are connected through a passageway positioned adjacent the bottoms of said chamber means and wherein said fluid communication occurs through said passageway.

8. A method of converting a varying stream of molten metal into a continuous stream comprising intermittently introducing into a non-pressurized first chamber of a multi-chambered tundish a varying input of molten metal, maintaining at least a predetermined quantity of molten metal within said first chamber of said tundish, attenuating transients within the molten metal in said first chamber, passing said molten metal from said first chamber to a second pressurized chamber of said tundish, maintaining at least a first predetermined level of molten metal within said second chamber, and controllably varying the pressure within said second chamber, by introduction of an inert gas thereby to provide a continuous stream of molten metal exiting from said second chamber.

9. A method according to claim 8 wherein the step of introducing into said multichambered tundish a varying input of molten metal includes pouring molten metal in discrete batches.

10. A method according to claim 6 wherein the step of attenuating transients within said molten metal includes disposing within said first chamber a plurality of baffles and contacting said molten metal with said baffles.

11. A method according to claim 8 wherein the step of controlling the pressure within said second chamber comprises the steps of sealing a predetermined portion of said second chamber and introducing to the sealed portion of said other chamber, a controlled pressure of an inert gas.

12. A method according to claim 11 wherein the step of controlling the pressure within said second chamber comprises correspondingly controlling said continuous stream of molten metal exiting from said second chamber to the exterior of said tundish.

* * * * *